US006155915A

United States Patent [19]

Raeder

[11] Patent Number: 6,155,915

[45] Date of Patent: Dec. 5, 2000

[54] SYSTEM AND METHOD FOR INDEPENDENT AIR BEARING ZONING FOR SEMICONDUCTOR POLISHING DEVICE

[75] Inventor: Christopher H. Raeder, Austin, Tex.

[73] Assignee: Advanced Micro Devices, Inc., Sunnyvale, Calif.

[21] Appl. No.: 09/275,654

[22] Filed: Mar. 24, 1999

[51] Int. Cl.[7] ..... B24B 29/00; B24B 5/00

[52] U.S. Cl. ..... 451/285; 451/288

[58] Field of Search ..... 451/41, 288, 287, 451/285, 289, 388, 397, 398

[56] References Cited

U.S. PATENT DOCUMENTS 5,800,248 9/1998 Pant et al. ..... 451/289

5,987,616 11/1999 Suzuki ..... 713/320

*Primary Examiner*—Rodney A. Butler

*Attorney, Agent, or Firm*—LaRiviere, Grubman & Payne, LLP

[57] ABSTRACT

A polishing assembly for CMP of semiconductors includes an air bearing platen having multiple concentric rings of air holes, with each ring defining an air delivery zone. Each ring includes air source holes alternating with air drain holes. A distribution plate is mated with the platen, and the distribution plate has alternating rings of air supply and air exhaust rings. The air supply rings include air supply apertures that are aligned with the air source holes in the platen, and the air exhaust rings include air exhaust apertures that are aligned with the air drain holes in the platen. With this structure, the air distribution profile of each air delivery zone can be established relatively independently of the profiles of the other zones.

19 Claims, 2 Drawing Sheets

SYSTEM AND METHOD FOR INDEPENDENT AIR BEARING ZONING FOR SEMICONDUCTOR POLISHING DEVICE

TECHNICAL FIELD

The present invention relates generally to semiconductor fabrication, and more particularly to methods and apparatus for polishing semiconductor devices during production.

BACKGROUND OF THE INVENTION

Semiconductor chips or wafers are used in many applications, including as processor chips for computers, and as integrated circuits and as flash memory for hand held computing devices, wireless telephones, and digital cameras. Regardless of the application, it is usually necessary that during one or more phases of the manufacturing process, semiconductor devices must be polished, typically using chemical-mechanical polishing (CMP) techniques, to remove excess portions of materials that are deposited for various reasons during preceding manufacturing phases.

In linear CMP techniques, a polishing platen is closely spaced from a polishing pad or belt that is to polish the surface of the wafer sought to be polished, with a very thin air space, referred to as an "air bearing", being defined between the platen and the polishing pad. It is advantageous to maintain an air bearing between the platen and the pad to promote uniform polishing of the surface. More specifically, the polishing uniformity can be precisely controlled using an air bearing.

To maintain the air bearing, air source holes are formed in the platen and are arranged in concentric ring patterns from the center of the platen to the outer edge of the platen. Each ring establishes an air delivery zone. Air from an air source is directed through the holes during polishing, thus establishing the air bearing. Air is exhausted past the platen edge.

With multiple air delivery zones, it is desirable to radially vary the air distribution profile of the air bearing (to vary the polishing rate in each zone) as necessary to achieve optimal polishing. As recognized by the present invention, however, when air can be exhausted from all air delivery zones only past the platen edge, the distribution profiles of the zones are not completely independent of each other. This complicates establishing different distribution profiles for different zones. Fortunately, the present invention recognizes that is possible to establish greater independence of the air distribution profiles, zone to zone, to thereby facilitate establishing the polishing rate in each zone independently of the other zones and, hence, to improve manufacturing flexibility and functionality.

BRIEF SUMMARY OF THE INVENTION

A polishing assembly for a semiconductor processing apparatus includes an air bearing platen that has multiple concentric air hole rings. Each air hole ring includes alternating air source holes and air drain holes, and each air hole ring defines an air delivery zone. A distribution plate is mated with the platen. As disclosed in detail below, the distribution plate has concentric alternating air supply rings and air exhaust rings. The air supply rings include air supply apertures that are aligned with the air source holes in the platen, and the air exhaust rings include air exhaust apertures that are aligned with the air drain holes in the platen. With this structure, the air distribution profile of each air delivery zone can be established independently of the profiles of the other zones.

In a preferred embodiment, a supply plate is mated with the distribution plate, and the supply plate has air supply channels and air exhaust channels respectively communicating with the air supply rings and air exhaust rings of the distribution plate. Moreover, in the preferred embodiment the platen defines a center, and air source holes are aligned with each other along first radials originating at the center. Air drain holes are aligned with each other along second radials originating at the center. As also envisioned herein, air supply apertures in the distribution plate overlap air exhaust apertures in the radial dimension, and air supply apertures alternate with air exhaust apertures in the azimuth dimension. A semiconductor processing apparatus that is engageable with the polishing assembly, and a semiconductor device that is made using the polishing assembly, are also disclosed.

In another aspect, an air bearing platen includes a plate defining plural air delivery zones, with at least two air delivery zones including at least one respective air source and at least one respective air drain.

In still another aspect, a semiconductor apparatus polishing assembly includes means for establishing plural air delivery zones in an air bearing. Also, the apparatus includes means for supplying air to each zone. For at least two zones, the polishing apparatus includes respective means for exhausting air from each zone.

Other features of the present invention are disclosed or apparent in the section entitled "DETAILED DESCRIPTION OF THE INVENTION".

DETAILED DESCRIPTION OF THE INVENTION

Figure 1:
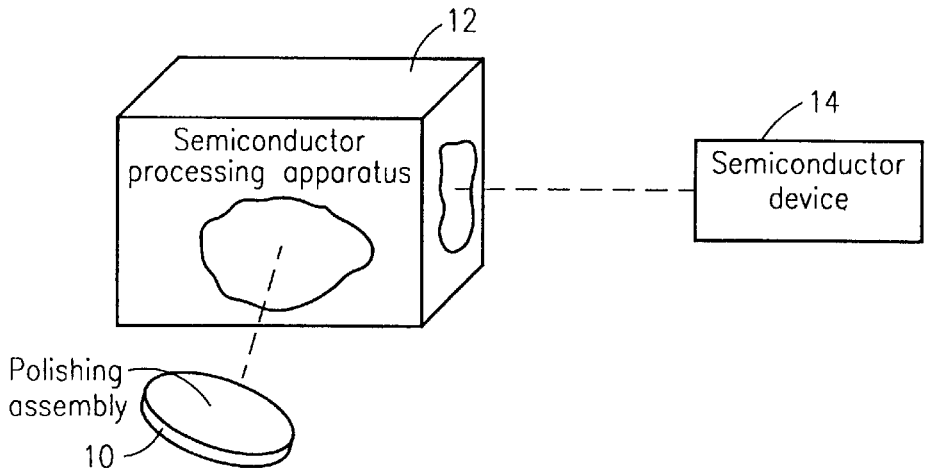
FIG. 1 is a schematic diagram of a semiconductor manufacturing apparatus in operable relationship with the present polishing assembly, showing a semiconductor device made according to the present invention.

Referring initially to FIG. 1, a polishing assembly 10 is shown in an exploded relationship with a semiconductor processing apparatus 12. The apparatus 12 rotates the polishing assembly 10 to polish semiconductor devices during manufacturing in accordance with principles known in the art, to produce semiconductor devices 14.

Figure 2:
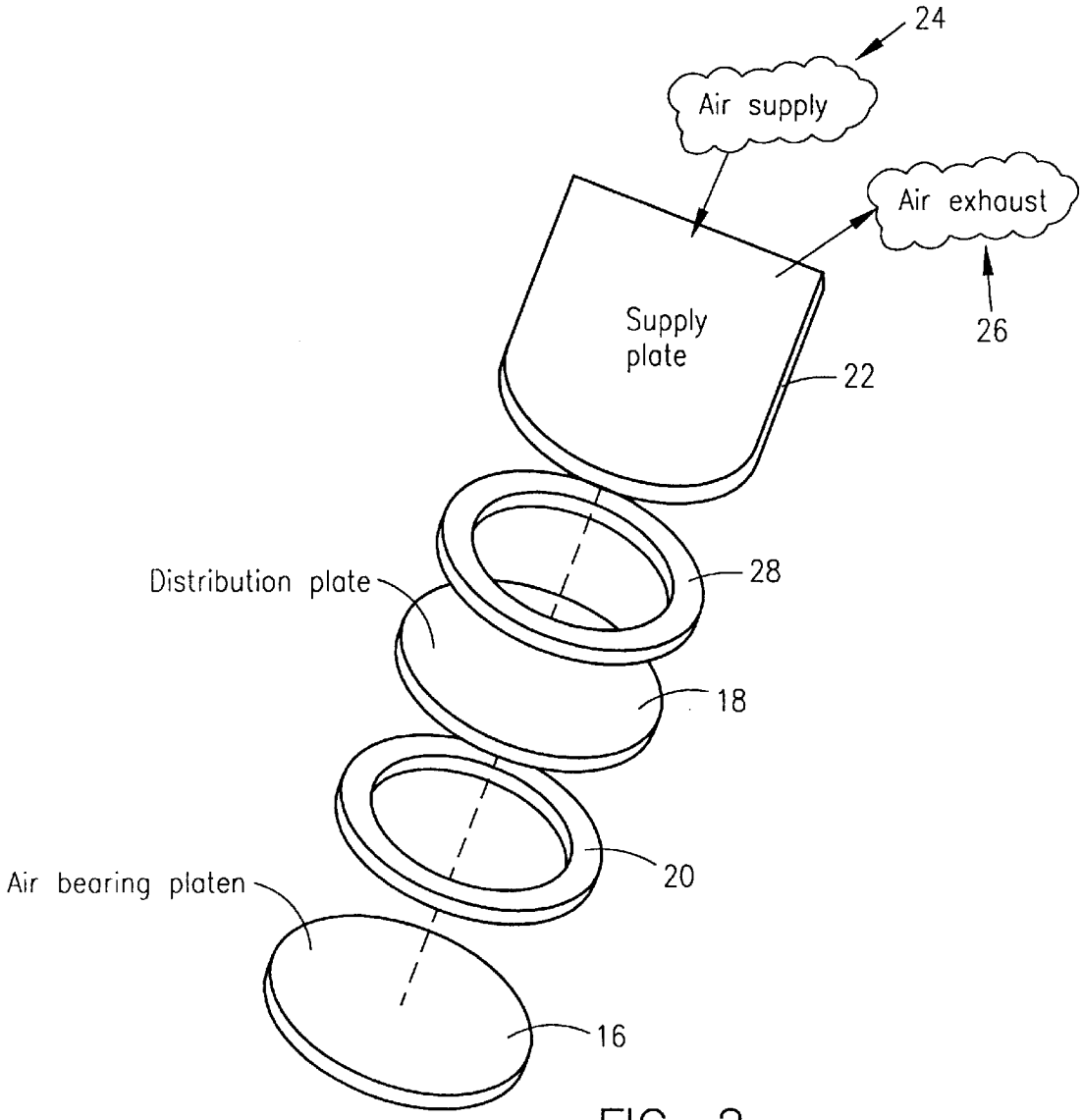
FIG. 2 is an exploded perspective view of the present polishing assembly, with the air holes of the platen and the air supply and exhaust rings of the distribution plate removed for clarity.

FIG. 2 shows the polishing assembly 10 in greater detail. As shown, the polishing assembly 10 includes an air bearing platen. The platen 16 can be disk-shaped as shown or some other suitable shape, e.g., parallelepiped-shaped or a modified disk shape. In composition the platen 16 is made of a suitable metal, ceramic, or plastic.

A metal, plastic, or ceramic air distribution plate 18 is mated with the platen 16, and if desired, a platen gasket 20 can be sandwiched between the distribution plate 18 and the platen 16. The distribution plate 18 can be engaged with the platen 16 by threaded fasteners. Alternatively, the distribution plate 18 can be engaged with the platen 16 by rivets, clips, welding, soldering, brazing, or other appropriate means.

In the preferred embodiment, a metal, ceramic, or plastic air supply plate 22 is mated with the distribution plate 18, and the air supply plate 22 communicates with an air supply 24 and an air exhaust 26. By means of illustration and without limitation, the air supply 24 can be any suitable supply of clean, filtered air, such as a pressure tank, blower, or other apparatus, whereas the air exhaust 26 can be any suitable exhaust such as a pipe, cavity, vacuum pump, and so on. The supply plate 22 can be engaged with the distribution plate 18 preferably by a gasket or by other means such as threaded fasteners, rivets, clips, welding, soldering, brazing, or other appropriate means. As shown, the supply plate 22 has a semicircular periphery 22*a* and a rectangular periphery 22*b* that is contiguous to the semicircular periphery 22*a*. The air supply plate 22 can have other shapes, however, including a disk shape. If desired, the platen 16 and distribution plate 18 can be made integrally with each other, as can be the distribution plate 18 and the supply plate 22.

In any case, the air supply plate 22 directs air into the air distribution plate 18, which in turn directs air to the air bearing platen 16. Moreover, air from the air bearing that is established by the platen 16 is returned via the plates 18, 22 to the air exhaust 26. A supply plate gasket 28 can be sandwiched between the distribution plate 18 and air supply plate 22 if desired.

Figure 3:
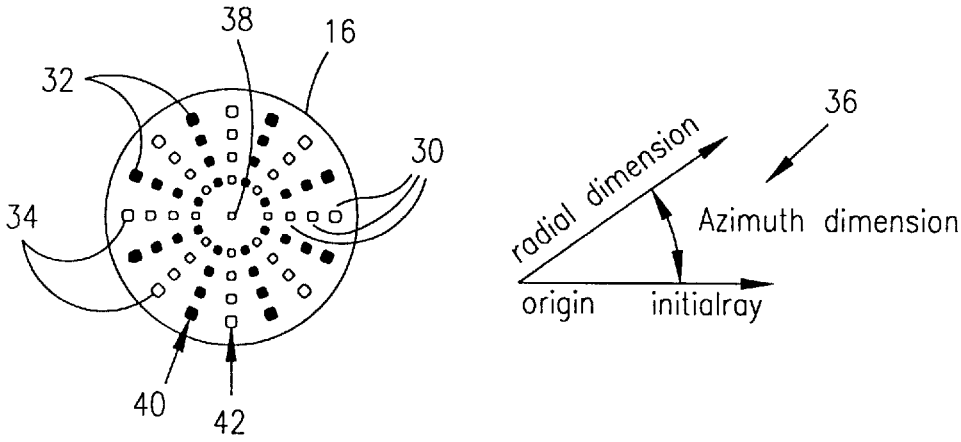
FIG. 3 is a top plan view of the air bearing platen with air source holes darkened in and air drain holes not darkened, showing a polar coordinate system for reference.

Now considering FIG. 3, the air bearing platen 16 can be seen in greater detail. As shown, the platen 16 includes plural concentric rings 30 each of which is defined by a circular pattern of holes. As intended by the present invention, beneath each ring 30 a respective polishing zone is established.

In the preferred embodiment, each ring 30 includes annular air source holes 32 and annular air drain holes 34, with the source holes 32 of a ring 30 alternating with the drain holes 34 of the ring 30 in the azimuth dimension illustrated in the accompanying polar coordinate reference system 36. It is to be understood that the origin of the polar coordinate system 36 is the center 38 of the platen 16. It is to be appreciated in reference to FIG. 3 that the holes 32, 34 extend completely through the platen 16. In one preferred embodiment, source holes 32 are aligned with each other along source radials 40, whereas drain holes 34 are aligned with each other along drain radials 42.

While the above description sets forth one presently preferred embodiment, it is to be understood that modifications can be made and still fall within the scope of the present invention. For example, the holes 32, 34 need not be radially aligned. Or, source and drain holes 32, 34 can be aligned along common radials, with source holes 32 alternating with drain holes 34 from the center 38 of the platen 16 outward along each radial. Still further, while FIG. 3 is intended to show that all holes 32, 34 are the same size, the holes 32, 34 in one ring 30 need not be the same size as holes 32, 34 in another ring 30. And, while FIG. 3 shows that each ring 30 includes the same number of holes 32, 34 as every other ring 30, some rings 30 can have fewer holes than other rings 30. For example, smaller rings 30 can have fewer holes 32, 34 than other rings 30, and can perhaps also have smaller holes 32, 34. Furthermore, while the holes 32, 34 are annular (i.e., circular in two dimensions) as shown, the holes 32, 34 can have other shapes, such as rectangular, or triangular, or other polygonal shapes or even curved shapes other than circular. As yet further examples of alternate embodiments, each ring 30 can be established by a pair of closely spaced concentric circular source and drain sub-rings, with each source sub-ring including only source holes 32 and each drain sub-ring 34 including only drain holes 34.

In any case, all the above examples provide at least two, and preferably all, air delivery zones with their own respective air drain holes, in contrast to existing air bearing platens. With this feature, the air distribution profile of each air delivery zone can be established independently of the other zones.

Figure 4:
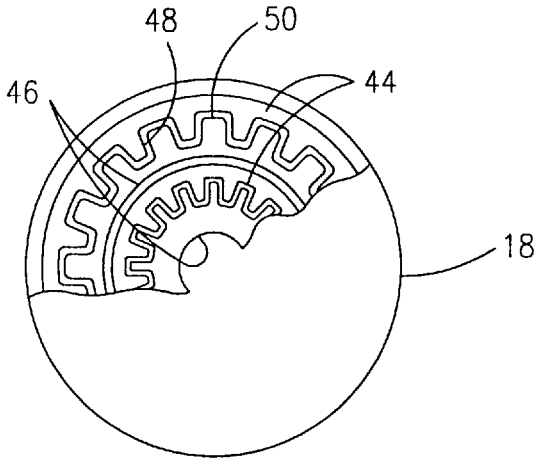
FIG. 4 is a top plan view of the distribution plate, showing only portions of the air supply and exhaust rings for clarity of disclosure.

To deliver air to the air source holes 32 and to exhaust air from the air drain holes 34, the air distribution plate 18 is mated with the platen 16 as set forth above. FIG. 4 shows a preferred air distribution plate 18 that includes plural concentric air supply rings 44 and, alternating with the air supply rings 44, concentric air exhaust rings 46. In the preferred embodiment shown, the air supply rings 44 include air supply apertures 48 that extend radially inwardly from the associated supply ring 44. In accordance with the present invention, the air supply apertures 48 extend through the distribution plate 18 and each supply aperture 48 is aligned with a respective air source hole 32 in the platen 16.

Moreover, the air exhaust rings 46 include air exhaust apertures 50, each of which is aligned with a respective air drain holes 34 in the platen 16 when the plate 18 is mated with the platen 16 as intended. The air exhaust apertures 50 of an exhaust ring 46 overlap, in the radial dimension, the air supply apertures 48 of the immediately outer adjacent air supply ring 44 as shown. As also shown, the exhaust apertures 50 of an exhaust ring 46 are staggered in the azimuth dimension with the air supply apertures 48 of the immediately outer adjacent air supply ring 44. With this structure, the alternating source/drain holes 32, 34 in the platen 16 respectively communicate with supply/exhaust apertures 48, 50 in the distribution plate 18. If desired, the outer ring of the pair can be the exhaust ring and the inner ring can be the supply ring. It is to be understood that the apertures 48, 50 can be arranged differently than shown in FIG. 4 as appropriate for the various alternative configurations of the platen 16 discussed above.

Figure 5:
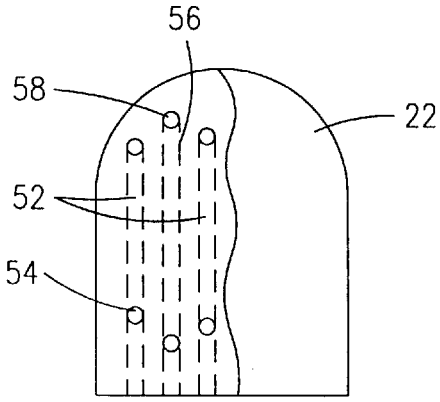
FIG. 5 is a bottom plan view of the air supply plate, showing portions (in phantom) of the air supply and exhaust lines.

Now referring to FIG. 5, the supply plate 22 has plural air supply channels 52 that communicate, via supply ports 54, with the air supply rings 44 of the air distribution plate 18. In the preferred embodiment shown, one supply channel 52 in the supply plate 22 is associated with a respective supply ring 44 in the distribution plate 18. Additionally, the supply plate 22 has plural air exhaust channels 56 that communicate, via exhaust ports 58, with the air exhaust rings 46 of the air distribution plate 18. In the preferred embodiment shown, one exhaust channel 56 in the supply plate 22 is associated with a respective exhaust ring 46 in the distribution plate 18. The supply channels 52 communicate with the air supply 24 shown in FIG. 2, and the exhaust channels 56 communicate with the air exhaust 26.

While the particular SYSTEM AND METHOD FOR INDEPENDENT AIR BEARING ZONING FOR SEMICONDUCTOR POLISHING DEVICE as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". Indeed, although a single transistor structure is shown in the drawings for clarity, the skilled artisan will appreciate that the chip 10 can include plural transistors, each substantially identical to that shown, as well as other circuit components. All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for".

What is claimed is:

1. A polishing assembly for a semiconductor processing apparatus, comprising:

at least one air bearing platen having multiple concentric air hole rings, each air hole ring including alternating air source holes and air drain holes, each air hole ring defining an air delivery zone; and at least one distribution plate mated with the platen, the distribution plate having concentric alternating air supply rings and air exhaust rings, the air supply rings including air supply apertures aligned with the air source holes in the platen, the air exhaust rings including air exhaust apertures aligned with the air drain holes in the platen, to establish the air distribution profile of each air delivery zone.

2. The polishing assembly of claim 1, further comprising a supply plate mated with the distribution plate, the supply plate having air supply channels and air exhaust channels respectively communicating with the air supply rings and air exhaust rings of the distribution plate.

3. The assembly of claim 1, wherein the platen defines a center and wherein air source holes are aligned with each other along first radials originating at the center and air drain holes are aligned with each other along second radials originating at the center.

4. The assembly of claim 1, wherein air supply apertures in the distribution plate overlap air exhaust apertures in the radial dimension, and wherein air supply apertures alternate with air exhaust apertures in the azimuth dimension.

5. The assembly of claim 1, further comprising a semiconductor processing apparatus engageable with the polishing assembly.

6. An air bearing platen, comprising:

a plate defining plural air delivery zones, at least two air delivery zones including at least one respective air source and at least one respective air drain, wherein each air delivery zone is established by at least one respective ring of holes including air source holes and air drain holes; and at least one distribution plate mated with the platen, the distribution plate having concentric alternating air supply rings and air exhaust rings, the air supply rings including air supply apertures aligned with the air source holes in the platen, the air exhaust rings including air exhaust apertures aligned with the air drain holes in the platen.

7. The platen of claim 6, wherein the rings of holes are concentric with each other.

8. The platen of claim 6, wherein the air source holes alternate in the azimuth dimension with air drain holes.

9. The platen of claim 6, wherein the platen defines a center and wherein air source holes are aligned with each other along first radials originating at the center and air drain holes are aligned with each other along second radials originating at the center.

10. The combination of claim 6, further comprising a supply plate mated with the distribution plate, the supply plate having air supply channels and air exhaust channels respectively communicating with the air supply rings and air exhaust rings of the distribution plate.

11. The combination of claim 6, wherein air supply apertures in the distribution plate overlap air exhaust apertures in the radial dimension, and wherein air supply apertures alternate with air exhaust apertures in the azimuth dimension.

12. The platen of claim 6, further comprising a semiconductor processing apparatus engageable with the platen.

13. An assembly, comprising:

means, including a platen, for establishing plural air delivery zones in an air bearing;

means, including a distribution plate mated with the platen, for supplying air to each zone; and for at least two zones, respective means for exhausting air from each zone.

14. The assembly of claim 13, wherein each zone includes respective means for exhausting.

15. The assembly of claim 13, wherein the platen has multiple air hole rings defined by air source holes and air drain holes.

16. The assembly of claim 13, further comprising a semiconductor processing apparatus engageable with the assembly.

17. The assembly of claim 15, wherein the distribution plate has air supply rings and air exhaust rings, the air supply rings including air supply apertures aligned with the air source holes in the platen, the air exhaust rings including air exhaust apertures aligned with the air drain holes in the platen.

18. The assembly of claim 17, further comprising a supply plate mated with the distribution plate, the supply plate having air supply channels and air exhaust channels respectively communicating with the air supply rings and air exhaust rings of the distribution plate.

19. The assembly of claim 18, wherein the platen defines a center and wherein air source holes are aligned with each other along first radials originating at the center and air drain holes are aligned with each other along second radials originating at the center, and further wherein air supply apertures in the distribution plate overlap air exhaust apertures in the radial dimension, the air supply apertures alternating with air exhaust apertures in the azimuth dimension.

* * * * *